US009708739B2

(12) United States Patent
Hall

(10) Patent No.: US 9,708,739 B2
(45) Date of Patent: Jul. 18, 2017

(54) TUFTED FABRIC WITH PILE HEIGHT DIFFERENTIAL

(71) Applicant: Card-Monroe Corp., Chattanooga, TN (US)

(72) Inventor: Wilton Hall, Ringgold, GA (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 15/088,780

(22) Filed: Apr. 1, 2016

(65) Prior Publication Data

US 2016/0289880 A1 Oct. 6, 2016

Related U.S. Application Data

(60) Provisional application No. 62/178,124, filed on Apr. 1, 2015.

(51) Int. Cl.
*D05C 15/32* (2006.01)
*D05C 15/36* (2006.01)

(52) U.S. Cl.
CPC ..... *D05C 15/32* (2013.01); *D05C 15/36* (2013.01)

(58) Field of Classification Search
CPC ..... D05C 17/02; D05C 15/30; D05C 15/32; D05C 15/12; D05C 15/06; D05C 15/14
See application file for complete search history.

(56) References Cited

U.S. PATENT DOCUMENTS 2,879,728 A 3/1959 McCutchen
2,889,791 A 6/1959 Fedevich
2,982,240 A 5/1961 McCutchen
2,990,792 A 7/1961 Nowicki et al.
3,017,847 A 1/1962 Keen
3,059,598 A 10/1962 Wade
3,084,645 A 4/1963 Card
(Continued)

FOREIGN PATENT DOCUMENTS

GB 1 541 074 A 2/1979
GB 2002040 A 2/1979
(Continued)

OTHER PUBLICATIONS

International Search Report for PCT/US2016/025638, mail date of Jul. 22, 2016.

(Continued)

*Primary Examiner* — Danny Worrell, Jr.
(74) *Attorney, Agent, or Firm* — Womble Carlyle Sandridge & Rice LLP

(57) ABSTRACT

A system and method for forming synthetic/artificial grass or turf products in which a series of tufts of artificial/synthetic grass filaments or yarns are formed in a backing material with various graphic pattern effects being formed therewith. The system generally will include a pair of needle bars each having at least one row of needles mounted along a tufting zone and reciprocated through the backing to a desired penetration depth, and will present a desired set or group of yarns to a series of gauge parts mounted at differing elevations. A first or upstream one of the needle bars will be shifted to an off-gauge position to move the needles thereof into positions so as to not be engaged by their associated gauge parts. The yarns fed to these needles further can be controlled to substantially pull back or otherwise prevent tufts of such yarns from being formed in the backing.

17 Claims, 9 Drawing Sheets

(56) References Cited

U.S. PATENT DOCUMENTS

| | | | |
|---|---|---|---|
| 3,103,903 | A | 9/1963 | Broadrick et al. |
| 3,375,797 | A | 4/1968 | Gaines |
| 3,489,326 | A | 1/1970 | Singleton |
| 3,577,943 | A | 5/1971 | Watkins |
| 3,662,697 | A | 5/1972 | Passons et al. |
| 3,709,173 | A | 1/1973 | Greene |
| 3,757,709 | A | 9/1973 | Cobble |
| 3,780,678 | A | 12/1973 | Short |
| 3,835,797 | A | 9/1974 | Franks et al. |
| 3,847,098 | A | 11/1974 | Hammel, Jr. |
| 3,919,953 | A | 11/1975 | Card et al. |
| 4,048,930 | A | 9/1977 | Card |
| 4,103,629 | A | 8/1978 | Card |
| 4,119,049 | A | 10/1978 | Puckett |
| 4,134,348 | A | 1/1979 | Scott |
| 4,138,956 | A | 2/1979 | Parsons |
| 4,155,319 | A | 5/1979 | Short |
| 4,158,339 | A | 6/1979 | Short |
| 4,185,569 | A | 1/1980 | Inman |
| 4,195,580 | A | 4/1980 | Hurst |
| 4,217,837 | A | 8/1980 | Beasley et al. |
| 4,226,196 | A | 10/1980 | Booth |
| 4,241,676 | A | 12/1980 | Parsons et al. |
| 4,245,574 | A | 1/1981 | Wilson |
| 4,267,787 | A | 5/1981 | Fukuda |
| 4,303,024 | A | 12/1981 | Bardsley |
| 4,313,388 | A | 2/1982 | Biggs et al. |
| 4,353,317 | A | 10/1982 | Crumbliss |
| 4,366,761 | A | 1/1983 | Card |
| 4,375,196 | A | 3/1983 | Beasley |
| 4,397,249 | A | 8/1983 | Slattery |
| 4,398,479 | A | 8/1983 | Czelusniak, Jr. |
| 4,419,944 | A | 12/1983 | Passons et al. |
| 4,440,102 | A | 4/1984 | Card et al. |
| 4,448,137 | A | 5/1984 | Curtis et al. |
| 4,466,366 | A | 8/1984 | Hirotsu |
| 4,491,078 | A | 1/1985 | Ingram |
| 4,522,132 | A | 6/1985 | Slattery |
| 4,557,208 | A | 12/1985 | Ingram et al. |
| 4,557,209 | A | 12/1985 | Watkins |
| 4,574,716 | A | 3/1986 | Czelusniak, Jr. |
| 4,608,934 | A | 9/1986 | Card et al. |
| 4,619,212 | A | 10/1986 | Card et al. |
| 4,630,558 | A | 12/1986 | Card et al. |
| 4,637,329 | A | 1/1987 | Czelusniak, Jr. |
| 4,667,611 | A | 5/1987 | Yamamoto et al. |
| 4,669,171 | A | 6/1987 | Card et al. |
| 4,671,194 | A | 6/1987 | Frost et al. |
| 4,739,717 | A | 4/1988 | Bardsley |
| 4,754,718 | A | 7/1988 | Watkins |
| 4,790,252 | A | 12/1988 | Bardsley |
| 4,800,828 | A | 1/1989 | Watkins |
| 4,815,403 | A | 3/1989 | Card et al. |
| 4,836,118 | A | 6/1989 | Card et al. |
| 4,841,886 | A | 6/1989 | Watkins |
| 4,856,441 | A | 8/1989 | Kurata |
| 4,860,674 | A | 8/1989 | Slattery |
| 4,864,946 | A | 9/1989 | Watkins |
| 4,903,624 | A | 2/1990 | Card et al. |
| 4,903,625 | A | 2/1990 | Card et al. |
| 4,993,336 | A | 2/1991 | Mizunuma |
| 5,005,498 | A | 4/1991 | Taylor et al. |
| 5,058,518 | A | 10/1991 | Card et al. |
| 5,094,178 | A | 3/1992 | Watkins |
| 5,109,784 | A | 5/1992 | Lepe-Cisneros |
| 5,182,997 | A | 2/1993 | Bardsley |
| 5,224,434 | A | 7/1993 | Card et al. |
| 5,295,450 | A | 3/1994 | Neely |
| 5,400,727 | A | 3/1995 | Neely |
| 5,499,588 | A | 3/1996 | Card et al. |
| 5,509,364 | A | 4/1996 | Bardsley |
| 5,513,586 | A | 5/1996 | Neely et al. |
| 5,562,056 | A | 10/1996 | Christman, Jr. |
| 5,566,630 | A | 10/1996 | Burgess et al. |
| 5,572,939 | A | 11/1996 | Beatty |
| 5,575,228 | A | 11/1996 | Padgett, III et al. |
| 5,622,126 | A | 4/1997 | Card et al. |
| 5,645,001 | A | 7/1997 | Green et al. |
| 5,706,744 | A | 1/1998 | Card et al. |
| 5,706,745 | A | 1/1998 | Neely et al. |
| 5,743,201 | A | 4/1998 | Card et al. |
| 5,857,422 | A | 1/1999 | Neely et al. |
| 5,896,821 | A | 4/1999 | Neely et al. |
| 5,899,152 | A | 5/1999 | Bardsley et al. |
| 5,979,344 | A | 11/1999 | Christman, Jr. |
| 5,983,815 | A | 11/1999 | Card |
| 6,009,818 | A | 1/2000 | Card et al. |
| 6,014,937 | A | 1/2000 | Lovelady |
| 6,155,187 | A | 12/2000 | Bennett et al. |
| RE37,108 | E | 3/2001 | Neely |
| 6,213,036 | B1 | 4/2001 | Slattery |
| 6,244,203 | B1 | 6/2001 | Morgante et al. |
| 6,263,811 | B1 | 7/2001 | Crossley |
| 6,279,497 | B1 | 8/2001 | Lovelady |
| 6,283,053 | B1 | 9/2001 | Morgante et al. |
| 6,283,811 | B1 | 9/2001 | Peterson |
| 6,318,730 | B1 | 11/2001 | Neely |
| 6,439,141 | B2 | 8/2002 | Morgante et al. |
| 6,446,566 | B1 | 9/2002 | Bennett et al. |
| 6,502,521 | B2 | 1/2003 | Morgante et al. |
| 6,508,185 | B1 | 1/2003 | Morgante et al. |
| 6,516,734 | B1 | 2/2003 | Morgante et al. |
| 6,550,407 | B1 | 4/2003 | Frost et al. |
| 6,672,230 | B2 | 1/2004 | Green et al. |
| 6,675,729 | B2 | 1/2004 | Green |
| 6,725,789 | B1 | 4/2004 | Hall |
| 6,758,154 | B2 | 7/2004 | Johnston |
| 6,807,917 | B1 | 10/2004 | Christman et al. |
| 6,834,601 | B2 | 12/2004 | Card et al. |
| 6,834,602 | B1 | 12/2004 | Hall |
| 6,877,447 | B2 | 4/2005 | Frost et al. |
| 6,877,449 | B2 | 4/2005 | Morgante et al. |
| 6,945,183 | B2 | 9/2005 | Card et al. |
| 6,945,184 | B2 | 9/2005 | Frost et al. |
| 7,007,617 | B2 | 3/2006 | Johnston |
| 7,089,874 | B2 | 8/2006 | Morgante et al. |
| 7,096,806 | B2 | 8/2006 | Card et al. |
| 7,107,928 | B2 | 9/2006 | Chasteen et al. |
| 7,216,598 | B1 | 5/2007 | Christman, Jr. |
| 7,222,576 | B2 | 5/2007 | Kilgore |
| 7,237,497 | B2 | 7/2007 | Johnston |
| 7,284,492 | B2 | 10/2007 | Johnston |
| 7,296,524 | B2 | 11/2007 | Beverly |
| 7,347,151 | B1 | 3/2008 | Johnston et al. |
| 7,359,761 | B1 | 4/2008 | Christman, Jr. |
| 7,398,739 | B2 | 7/2008 | Johnston |
| 7,426,895 | B2 | 9/2008 | Smith et al. |
| 7,431,974 | B2 | 10/2008 | Lovelady et al. |
| 7,438,007 | B1 | 10/2008 | Hall |
| 7,490,566 | B2 | 2/2009 | Hall |
| 7,597,057 | B2 | 10/2009 | Johnston et al. |
| 7,634,326 | B2 | 12/2009 | Christman, Jr. et al. |
| 7,717,051 | B1 | 5/2010 | Hall et al. |
| 7,739,970 | B2 | 6/2010 | Hall |
| 7,905,187 | B2 | 3/2011 | Card et al. |
| 7,946,233 | B2 | 5/2011 | Hall et al. |
| 7,997,219 | B2 | 8/2011 | Jackson |
| 8,082,861 | B2 | 12/2011 | Lovelady et al. |
| 8,096,247 | B2 | 1/2012 | Monroe et al. |
| 8,141,505 | B2 | 3/2012 | Hall et al. |
| 8,141,506 | B2 | 3/2012 | Hall et al. |
| 8,201,509 | B2 | 6/2012 | Christman, Jr. |
| 8,240,263 | B1 | 8/2012 | Frost et al. |
| 8,347,800 | B1 | 1/2013 | Machell-Archer et al. |
| 8,359,989 | B2 | 1/2013 | Hall et al. |
| 8,443,743 | B2 | 5/2013 | Christman, Jr. |
| 8,646,396 | B2 | 2/2014 | Shanley |
| 8,776,703 | B2 | 7/2014 | Hall et al. |
| 8,915,202 | B2 | 12/2014 | Hall et al. |
| 9,260,810 | B2 | 2/2016 | Neely et al. |
| 9,290,874 | B2 | 3/2016 | Mathews et al. |
| 9,399,832 | B2 | 7/2016 | Hall et al. |
| 9,410,276 | B2 | 8/2016 | Hall et al. |
| 2004/0187268 | A1 | 9/2004 | Johnston |

(56) References Cited

U.S. PATENT DOCUMENTS

| | | | |
|---|---|---|---|
| 2007/0272137 | A1 | 11/2007 | Christman et al. |
| 2008/0210146 | A1 | 9/2008 | Hall |
| 2008/0245283 | A1 | 10/2008 | Landoni |
| 2009/0050037 | A1 | 2/2009 | Hall et al. |
| 2009/0078180 | A1 | 3/2009 | Hall |
| 2009/0101051 | A1 | 4/2009 | Christman |
| 2009/0205547 | A1 | 8/2009 | Hall et al. |
| 2009/0220728 | A1 | 9/2009 | Hall et al. |
| 2009/0260554 | A1 | 10/2009 | Hall et al. |
| 2010/0064954 | A1 | 3/2010 | Hall et al. |
| 2012/0174846 | A1 | 7/2012 | Hall et al. |
| 2013/0125801 | A1 | 5/2013 | Hall et al. |
| 2013/0180440 | A1 | 7/2013 | Hall |
| 2014/0000497 | A1 | 1/2014 | Modra |
| 2014/0283724 | A1 | 9/2014 | Frost et al. |
| 2014/0311392 | A1 | 10/2014 | Hall et al. |
| 2014/0331906 | A1 | 11/2014 | Hall et al. |
| 2015/0159323 | A1 | 6/2015 | Hall |
| 2015/0211161 | A1 | 7/2015 | Card |
| 2016/0032510 | A1 | 2/2016 | Hall et al. |
| 2016/0069010 | A1 | 3/2016 | Frost et al. |

FOREIGN PATENT DOCUMENTS

| | | | |
|---|---|---|---|
| GB | 2050447 | A | 1/1981 |
| GB | 2165560 | A | 4/1986 |
| GB | 2246371 | A | 1/1992 |
| GB | 2266537 | A | 11/1993 |
| WO | WO 01/20069 | A1 | 3/2001 |
| WO | WO 03/056091 | A1 | 7/2003 |
| WO | WO 2004/057111 | A1 | 7/2004 |
| WO | WO 2005/054561 | A1 | 6/2005 |
| WO | WO 2006/075241 | A1 | 7/2006 |
| WO | WO 2010/003050 | A2 | 1/2010 |
| WO | WO 2015/188139 | A1 | 12/2015 |

OTHER PUBLICATIONS

Written Opinion for PCT/US2016/025638, mail date of Jul. 22, 2016.

International Preliminary Report on Patentability dated Nov. 17, 2015 for PCT/US2014/037671.

International Search Report for PCT/US2014/037671, mailed Sep. 26, 2014.

Written Opinion for PCT/US2014/037671, mailed Sep. 26, 2014.

TUFTED FABRIC WITH PILE HEIGHT DIFFERENTIAL

CROSS REFERENCE TO RELATED APPLICATIONS

The present Patent Application is a formalization of previously filed, U.S. Provisional Patent Application Ser. No. 62/178,124, filed Apr. 1, 2015 by the inventor named in the present Application. This Patent Application claims the benefit of the filing date of this cited Provisional Patent Application according to the statutes and rules governing provisional patent applications, particularly 35 U.S.C. §119 (e), and 37 C.F.R. §§1.78(a)(3) and 1.78(a)(4). The specification and drawings of the Provisional Patent Application referenced above are specifically incorporated herein by reference as if set forth in their entirety.

FIELD OF THE INVENTION

The present invention generally relates to tufted fabrics or products, and in particular to a method and system for forming tufted fabrics having varying pile heights and/or patterned designs formed therein, including formation of artificial/synthetic sports grass or turf fabrics or products having an enhanced natural appearance.

BACKGROUND OF THE INVENTION

Carpets and other tufted products having script designs, varying pile heights, tip shearing effects, and other pattern effects have become increasingly popular as advancements in tufting machinery and/or systems have enabled improvements in the appearance of such graphic designs in such tufted articles. In addition, artificial or synthetic grass or turf products also have grown in popularity and demand, especially for use in indoor stadiums and in areas where grass fields are difficult to maintain due to weather conditions. Such synthetic turf products more recently have been formed as tufted products using synthetic turf yarns or filaments that simulate blades of grass tufted into a backing material, and with a fill material, such as ground up tires, sand, and/or other particulate matter, generally being applied between the tufts of the synthetic grass filaments to help support the tufts and provide cushioning.

The resultant synthetic turf or grass fabric further importantly must meet desired standards for cushioning, support, and other performance factors, as well as the amount of fill material used, especially where it is installed in sanctioned athletic fields, such as for professional, college, and high school sports facilities. For example, FIFA, the governing body for international soccer, has very specific standards for the amount of cushioning and support, as well as for ball bounce and the amount of fill that can be used in sanctioned synthetic turf soccer fields. There consequently is a continuing need to try to improve the cushioning, support and playability of synthetic turf fields, and to reduce the amount of fill or particulate matter needed to support the synthetic turf or grass filaments, which particulate matter often can get in players' eyes, etc., as it is disturbed during play, to improve the players' comfort and help reduce injuries as much as possible, and to reduce potential environmental concerns from such materials. It is also desirable to form such turf products with an appearance that simulates the look and feel of natural grass.

Accordingly, it can be seen that a need exists for a system and method for forming tufted products, including carpets and artificial/synthetic grass or sports turf products that address the foregoing and other related and unrelated problems in the art.

SUMMARY OF THE INVENTION

Briefly described, the present invention generally relates to a system and method for forming tufted fabrics, including carpets or other similar articles having varying pile heights and/or utilizing loop pile and/or cut pile tufts. In one example embodiment, the tufted fabrics formed using the system and method of the present invention can be formed from various types of yarns, including synthetic grass or turf type filaments or yarns, inserted into a backing material so as to form tufted artificial/synthetic grass or turf products with an enhanced or substantially natural look and feel. The present invention generally is adapted to utilize a tufting machine including one or more rows of needles positioned along one or more needle bars extending across a tufting zone of the tufting machine. In one embodiment, the needles can be arranged in spaced rows along a pair of reciprocating needle bars, with the rows of needles arranged in a staggered configuration. Each of the needles also generally includes a pickup area and carries a filament or yarn for introduction of the yarns into a backing material as the backing material is moved through the tufting zone. The needles of each needle bar generally can be positioned or adjusted, and/or can be of differing lengths, such that their pick-up areas will be located at different elevations or heights. One or both of the needle bars further can be shiftable in transverse directions with respect to the movement of the backing material through the tufting zone.

A gauging element assembly is located below the tufting zone. In one embodiment, the gauging element assembly generally can include one or more sets or series of gauging elements, for example, including a first series of cut pile hooks mounted at a first elevation below the backing material, generally along a first side (e.g., a downstream side) of the tufting zone. A second series of cut pile hooks also can be positioned along the tufting zone, and can be located at a different elevation from the first series of cut pile hooks, (e.g., at a second or higher elevation). Each of the cut pile hooks of each series of cut pile hooks will be reciprocated into and out of engagement with an associated pick-up area of corresponding or associated ones of the needles upon penetration of the backing material by the needles so as to pull and capture loops of yarns from the needles. Each of the cut pile hooks further can include an elongated body having a throat terminating in a hooked front end or barb adapted to engage a corresponding pick-up area of their associated or corresponding needles for capturing loops along their throats. The cut pile hooks of each series further can be mounted in a staggered configuration, and/or alternatively the throats of the cut pile hooks can be of a different size or configuration (e.g., a longer length) so as to engage the upstream and downstream rows of needles, respectively, which also be can of a longer length or penetrate to a greater depth sufficient to be engaged by the first series of cut pile hooks.

The tufting machine also generally will include a main driveshaft which drives the reciprocation of the needles into and out of the backing material, backing feed rollers which feed a backing material through the tufting zone, shift mechanisms for shifting one or both of the needle bars, and one or more yarn feed mechanisms arranged along upstream and/or downstream sides of the tufting zone. For example, a standard yarn feed can be used on the rear or downstream side of the tufting machine, while the yarn feed mechanism on the upstream side can include various pattern yarn feed attachments. A system controller including an operator input device can receive pattern instructions and feedback, and will include programming to control operation of the operative elements of the tufting machine, such as yarn feed, needle bar shifting, backing feed, etc., for forming tufts of selected yarns in the backing material.

As the backing material is fed through the tufting zone of the tufting machine, a series of base fabric tufts of yarns or synthetic filaments can be formed by the feeding of such yarns or filaments from the downstream yarn feed mechanism to the second, rear or downstream row of needles. The downstream yarn feed can be operated to feed the yarns in a generally standard feed operation, and thus can utilize standard yarn feed rolls without necessarily having to use pattern yarn feed attachments. As the second or downstream row of needles penetrates the backing material, the needles are engaged by the second series of cut pile hooks, so as to capture a series of loops of yarns thereon, after which knives can be reciprocated into engagement therewith so as to form the base or first series of cut pile tufts generally having a selected first length or base pile height. The first, front or upstream row of needles similarly will be engaged by the first series of cut pile hooks as the needles penetrate the backing material, so as to accordingly form a second series of cut pile tufts that can have a second, different selected length or pile height, for example being greater than the first pile height of the first or base series of tufts. The first or upstream series of needles further can be shifted transversely into an off gauge position, or otherwise into a position so as to be moved out of alignment with corresponding ones of their associated ones of the first series of cut pile hooks. In such a misaligned position, the upstream needles generally will not be engaged by their associated ones of the first series of cut pile hooks.

The system control further can control the yarns being fed to the needles of the first or upstream row of needles, for example, by substantially stopping, limiting or otherwise controlling the feeding of yarns thereto when the first or upstream row of needles have been shifted to their off-gauge or misaligned positions. As a result, these yarns can be controlled so as to be substantially pulled low or out of the backing material and can float across the rear surface of the backing material, as well as to vary pile height of resultant tufts formed thereby. The system control also can selectively shift at least the first or upstream row of needles between off-gauge and on-gauge positions or into positions to be engaged by associated or corresponding ones of the first series of cut pile hooks in order to form the second series of tufts having a different pile height or length in a selected manner. For example, the second series of tufts can be formed in a ratio of approximately 1:1.5 to approximately 1:4 with respect to first or base tufts, although other greater or lesser variations or selective formations of the second tufts in relation to the first series of tufts also can be provided. The first series of tufts thus can form a base fabric or turf generally having a substantially similar or generally consistent pile height or level surface, with the second series of tufts, which can have different pile heights, being intermixed or interspersed therebetween in order to provide the resultant artificial or synthetic turf product with an appearance and/or feel designed to more closely mimic the look and feel of natural grass. In addition, the placement of the second series of tufts further can be used to provide different patterning effects, such as to potentially enable shading or colored patterning effects, and to provide increased density to the resultant artificial or synthetic turf products.

Various features, objects and advantages of the present invention will become apparent to those skilled in the art upon a review of the following detailed description of the invention, when taken in conjunction with the accompanying drawings.

Figure 1:
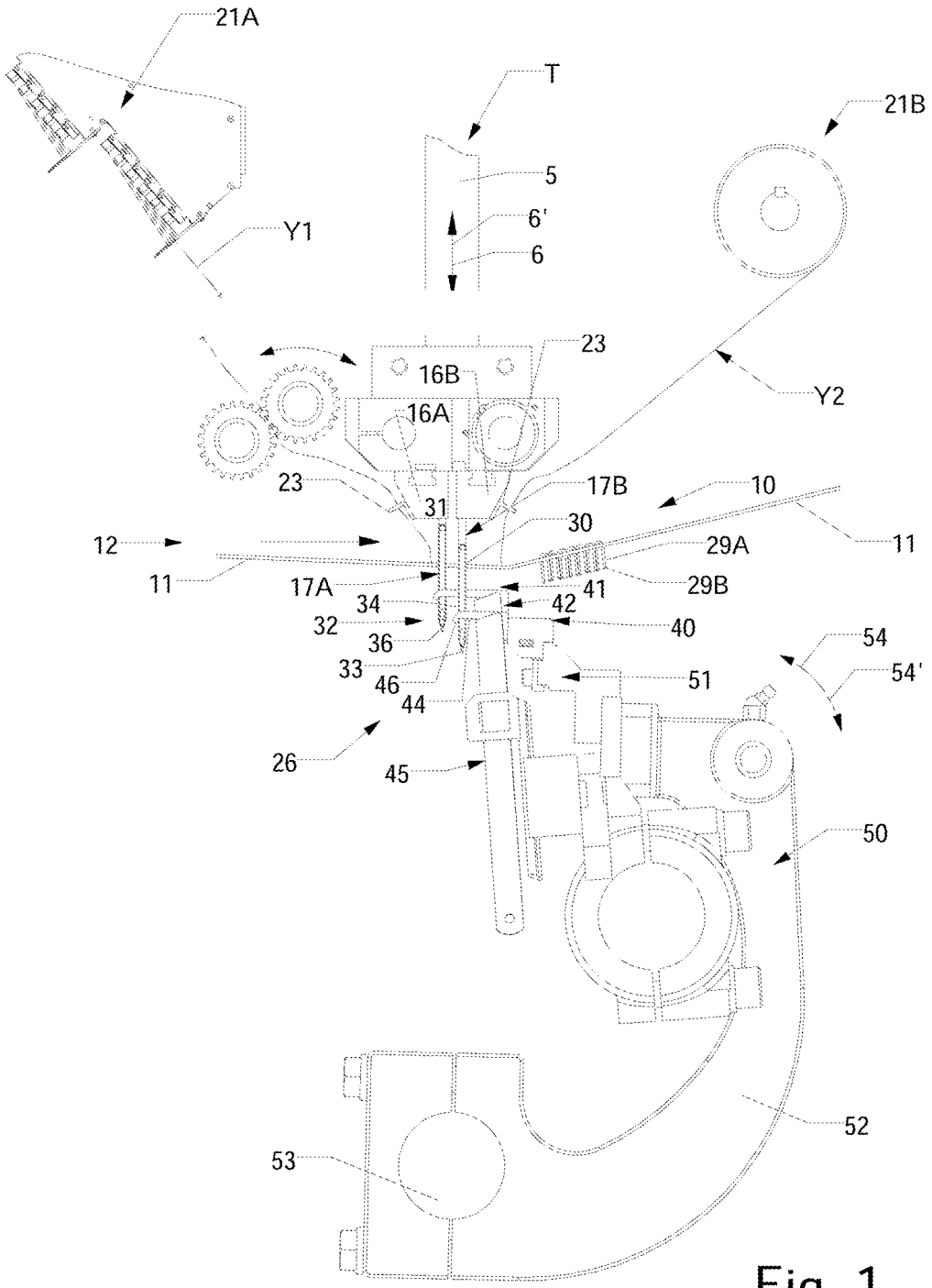
FIG. 1 is a side elevational view illustrating one embodiment of a tufting machine for use in forming tufted articles, including artificial/synthetic sports turf products according to the principles of the present invention.

It will be understood that the drawings accompanying the present disclosure, which are included to provide a further understanding of the present disclosure, are incorporated in and constitute a part of this specification, illustrate various aspects, features, advantages and benefits of the present disclosure and invention, and together with the following detailed description, serve to explain the principals of the present invention. In addition, those skilled in the art will understand that, accordingly, in practice, various features of the drawings discussed herein are not necessarily drawn to scale, and that dimensions of various features and elements shown or illustrated in the drawings and/or discussed in the following Detailed Description may be expanded, reduced or moved to an exploded position in order to more clearly illustrate the principles and embodiments of the present invention as set forth in the present disclosure.

DETAILED DESCRIPTION OF THE INVENTION

Figure 2:
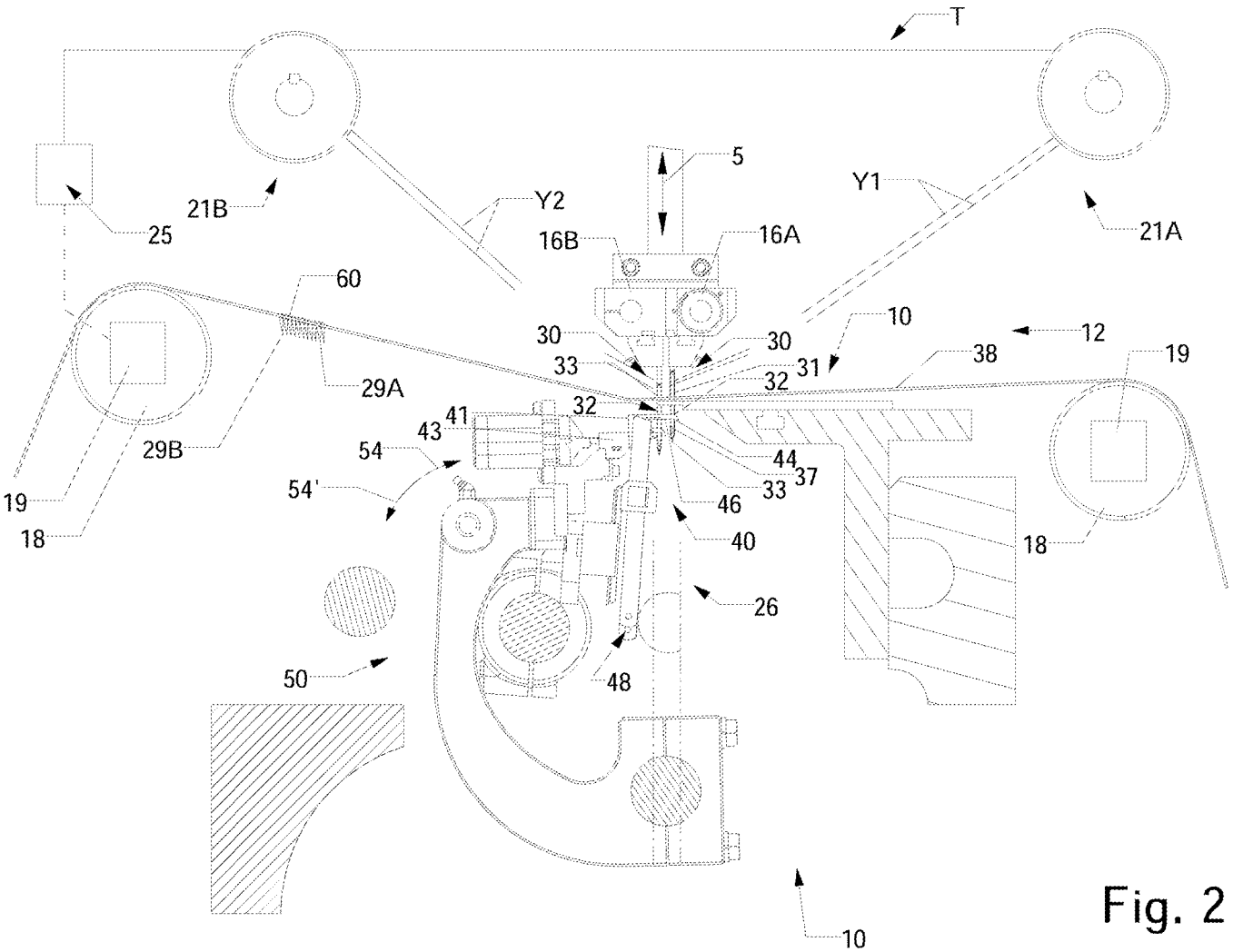
FIG. 2 is a perspective illustration of a tufting machine according to the principles of the present invention, illustrating in further detail the tufting zone of the tufting machine for forming tufts with different pile heights.
Figure 3:
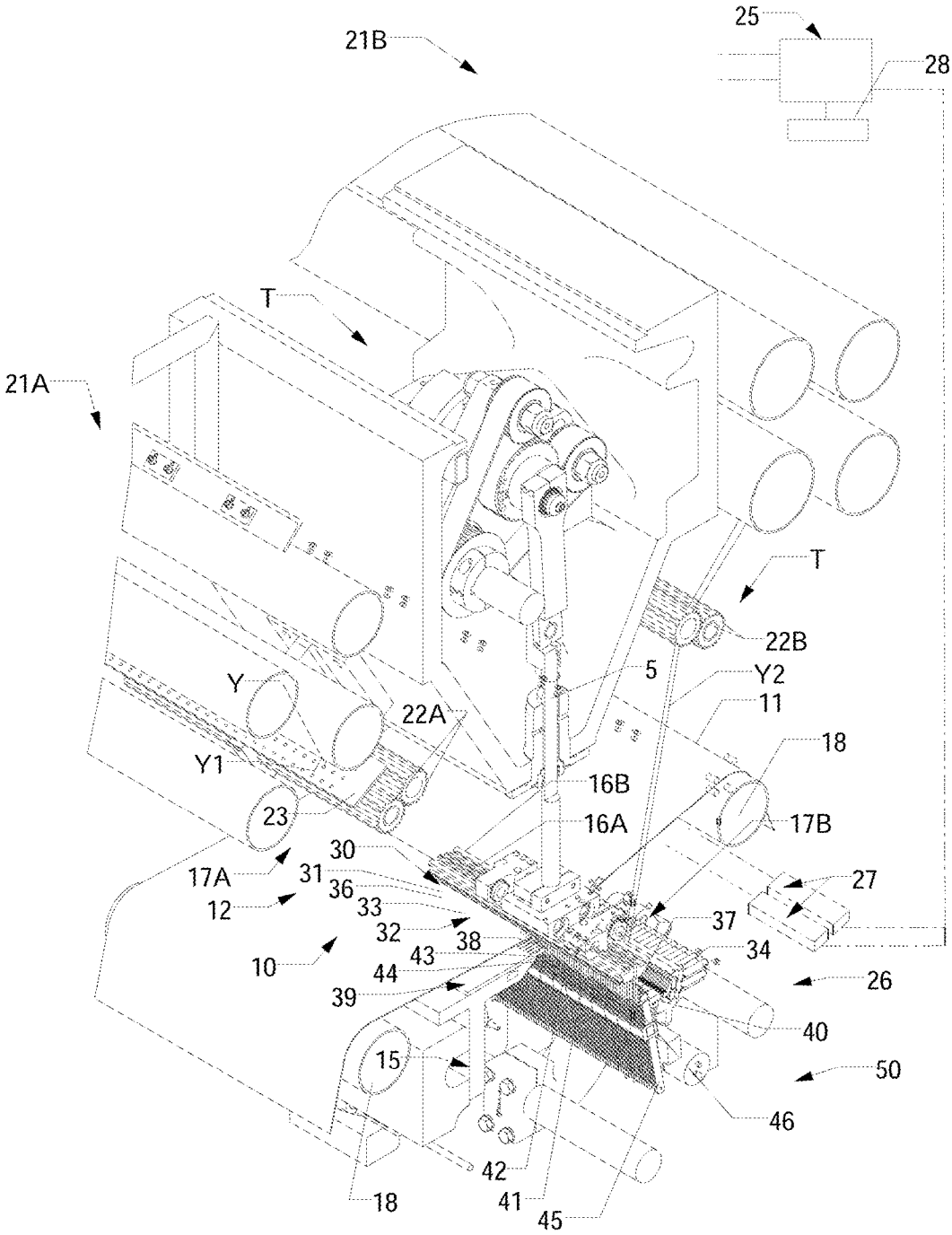
FIG. 3 is a perspective illustration of the tufting machine of FIGS. 1-2.

Referring now in greater detail to the drawings in which like numerals indicate like parts throughout the several views, the present invention generally relates to a method and system for forming patterned tufted fabrics which can include multiple pile height and/or varying color graphic patterns. In one example embodiment described herein the present invention provides a system and method of tufting patterned articles that can have cut pile tufts of yarns, including synthetic grass filaments or yarns formed at varying pile heights for forming tufted carpets or other articles such as artificial/synthetic grass or turf products. As illustrated in FIGS. 1-3, a tufting machine T utilizing the present invention generally will include a tufting zone 10 through which a backing material 11 is fed, as generally indicated by arrow 12 for the introduction of yarns (shown by dashed lines Y1, et. seq.) into the backing material. The yarns further can be controlled so as to be pulled low or out of the backing material or can be otherwise controlled so as to hide selected yarns along the face of the finished tufted article as needed.

As indicated in FIG. 1, the tufting machine T generally can comprise a tufting machine such as disclosed in U.S. Pat. Nos. 5,979,344, 7,096,806 and/or 7,359,761, the disclosures of which are incorporated by reference as if fully set forth herein. The tufting machine T generally will include a frame 15 on which is supported a machine drive 5, including a main drive shaft that reciprocally drives a pair of reciprocating needle bars 16A/16B each carrying one or more rows of needles 17A/17B mounted in spaced series therealong, in the direction of arrows 6 and 6'. A first or front row of needles 17A mounted along the upstream or front needle bar 16A generally can be mounted in a staggered arrangement with respect to the second or rear row of needles 17B of the downstream or rear needle bar 16B. The backing material 11 is fed through the tufting zone 10 by upstream and downstream backing rolls 18 driven by motors 19 (FIG. 2) and is engaged by the reciprocation of the needles. While a pair of needle bars each with staggered rows of needles 17 are generally shown and discussed with respect to the embodiments illustrated in FIGS. 1-3, it also will be possible to utilize other configurations of needle bars. A series of yarns, indicated by Y1 et seq., (FIGS. 1-4A and 5C) are fed from one or more upstream and downstream yarn feed mechanisms or devices 21A/21B, typically being fed or pulled between pairs of puller rolls 22A and 22B (FIGS. 1 and 3), and through yarn guides 23, to each of the needles 17A/17B.

In addition, a system control 25 (FIGS. 2-3), such as a Command Performance™ Tufting Machine Control as manufactured by Card-Monroe Corp. can be linked to the yarn feed mechanism 21A/21B, backing feed motors 19, the main drive shaft motor(s) driving the main shaft and reciprocation of the needle bars 16A/16B, a gauging element assembly 26, at least one shifter mechanisms 27 (FIG. 3) linked to at least one of the needle bars for transverse shifting of at least one of the needle bars, and other operative systems/elements of the tufting machine for control thereof. The system control includes an operator input 28 such as a keyboard or touch screen, and can be networked to other control systems, including a design center and/or other control systems. The system control can receive pattern instructions and can include programming, including being linked to a server, and will control the various operative elements of the tufting machine T including the backing feed, operation/reciprocation of the needle bars and gauging assembly 26 of the tufting machine, and the yarn feed mechanisms 21A/21B controlling the feeding of the yarns Y1-Y2 to the rows of needles 17A/17B to form the desired graphic patterned tufted articles.

The yarns Y1, et. seq., used to form a tufted turf fabric in accordance with the principles of the present invention generally can include synthetic grass filaments or other material filaments, yarns as commonly used for such turf fabrics, carpets, and/or other tufted fabrics. The yarns generally are fed to the needles 17A/17B from the one or more yarn feed mechanisms 21A/21B and are inserted into the backing material 11 as the needles penetrate the backing 11, whereupon the yarns will be engaged by the gauging elements of the gauging element assembly 26 of the tufting machine T in order to form tufts of the yarns, including first or base tufts 29A and second tufts 29B that can be of a different type or pile heights, within the backing material 11 in accordance with the pattern instructions programmed into or received by the system control. The front yarn feed mechanism(s) 21A generally can include scroll, roll, servo-scroll, single-end yarn feed, double-end yarn feed and/or other types of pattern and non-pattern yarn feed devices, such as an Infinity™, Infinity IIE™ Yarntronics™ yarn feed systems or mechanisms such as manufactured by Card-Monroe Corp., or other yarn feed systems as needed for controlling feeding of the yarns to form various pattern effects in the finished tufted turf fabrics. The rear yarn feed mechanism(s) 21B can generally include similar yarn feed systems, including, in one embodiment, the use of standard yarn feed rolls that can feed the yarns at substantially fixed, pre-set or otherwise controlled rates.

As illustrated in FIGS. 1, 2 and 4A-4B, in each of the needles 17A/17B generally will include an elongated shank or body 30 having an upper end 31 received in or along the needle bars 16A/16B (as indicated in FIGS. 1-2), or within a module or block attached to each needle bar, and a distal or second end 32 that terminates in a pointed tip 33. In the embodiment of the needles illustrated in FIGS. 1-2, the needles generally can be mounted at different elevations or their positions with respect to each other can be adjusted to differing elevations, or alternatively the needle shanks can be of different lengths, such that the upstream needles 17A will be provided with at least one, i.e., a first, pick-up area 34 formed adjacent the distal end 32 of each needle, that is at a different elevation, i.e., located above a second pick-up area 36 of the second row of needles 17B.

As a result, the needles 17A/17B can penetrate the backing material so as to present the yarns carried thereby at different or varying penetration depths, whereupon the respective first and second pick-up areas of the needles 17A/17B will be engaged by associated ones of the gauge parts of the gauging assembly 26 arranged at corresponding elevations or penetration depths to form tufts of yarns having different or varying pile heights, as indicated in FIGS. 4A-4B, 5A-5B and 5D. An eye or similar opening 37 (FIG. 2) generally is formed adjacent the pointed tip 33 of each needle and receives a yarn therethrough. As the needles are engaged by the gauge parts of the gauging assembly 26, the yarns can be selectively picked and pulled or otherwise removed from their needle by at least one of the opposed gauge parts reciprocated into engagement therewith to form tufts of yarns in the backing material as needed in accordance with the programmed pattern instructions. As indicated in FIGS. 3 and 4A-5A and 5D, the needles will pass between fingers or reeds 38 of a needle plate 39 as they penetrate the backing material.

Figure 4A:
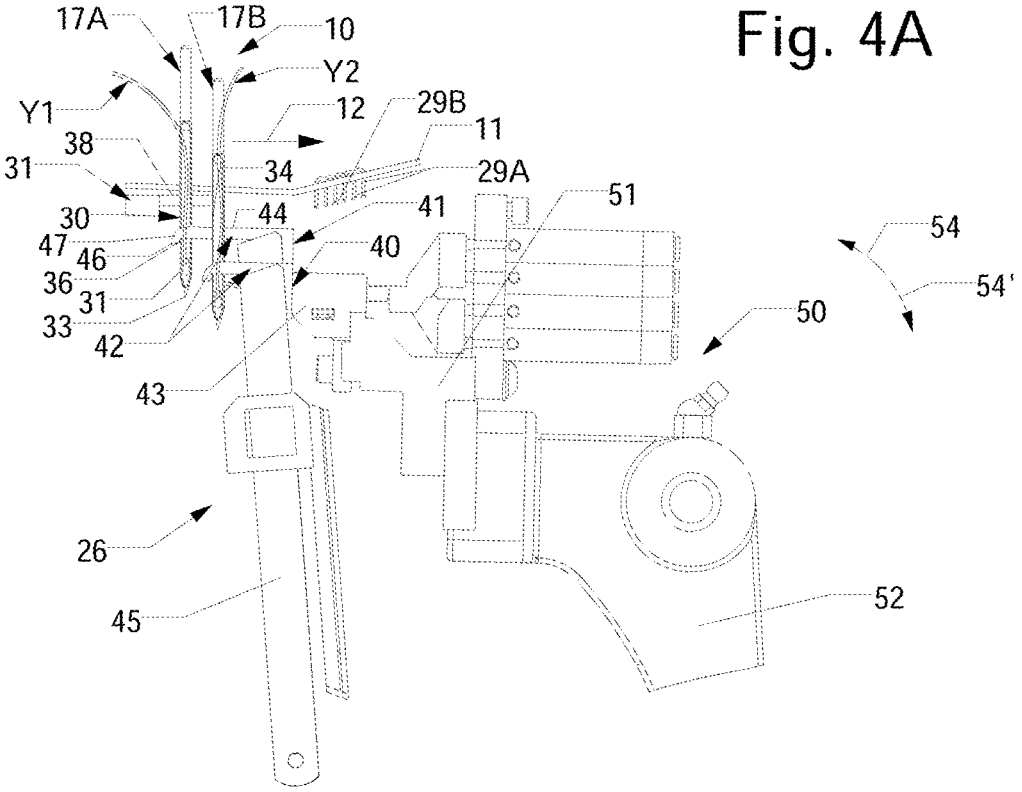
FIGS. 4A-4B are side elevational views of an example embodiment of a gauging element assembly and needles of the tufting machines of FIGS. 1-3.

In one embodiment, as illustrated in FIGS. 1-3, the gauge parts of the gauging assembly 26 generally can include first and second series or sets of gauge parts. For example, a first series of cut pile hooks 40, can be mounted along a downstream side at the tufting zone 10, located at a first elevation or position below the backing material, and will be reciprocated toward and away from engagement with the upstream needles 17A. A second series of gauge parts, which can also include cut pile hooks 41, can be mounted at a second, different elevation (i.e., at a higher elevation or location than the first series of cut pile hooks) so as to engage the downstream needles 17B. In the illustrated embodiment, each cut pile hook 40/41 (FIG. 4A) each generally will include an elongated body 42 having a rear or shank portion 43 and a forwardly extending throat portion 44. The throat 44 of each cut pile hook generally terminates at a hooked end or barb 46, which further can include beveled or contoured surfaces 47, and along which knives 45 associated with each of the cut pile hooks 40/41 can be reciprocated into engagement therewith to cut the loops of yarns for forming at pile tufts, as indicated in FIGS. 1-3. As indicated in FIGS. 1-2 and 4A, the throats 44 of the first and second cut pile hooks 40 and 41 can be of substantially the same length, with the lower or first cut pile hooks 40 generally being mounted in a position located forward of the upper or second cut pile hooks 41. Alternatively, the throats of the lower cut pile hooks 40 can be of a different length than the upper cut pile hooks 41 to enable engagement of the needles 17A of the first row of needles.

The system and method of forming artificial/synthetic sports grass or turf fabrics according to the present invention generally can utilize a drive system 50 or configuration for driving the gauging assembly 26, such as indicated in the attached FIGS. 1-3, and as shown in U.S. Pat. No. 7,946,233, the disclosure of which is incorporated herein as if set forth in its entirety; and with the lengths of yarns fed from the yarn feed device(s) being controlled to accommodate the engagement and pulling of yarns from the needles by the corresponding gauge parts (as needed) without excess yarns being accumulated above the backing material. Additionally, other machine configurations, systems and arrangements of loop pile loopers, cut pile hooks, level cut loop loopers and other gauge parts also can be used, such as shown in U.S. Pat. No. 7,438,007, the disclosure of which is incorporated herein by reference as if set forth in its entirety.

As also indicated in FIGS. 1-5, the gauging assembly 26 of the tufting machine T of the present invention can be driven by various types of drive systems 50. For example, as shown in FIG. 1, the first and second cut pile hooks 40/41 each can be mounted along modules and/or gauge/hook bars 51 driven off the main driveshaft of the tufting machine by linkage arms 52 connected to and operating off a jackshaft or rocker shaft 53 that is linked to the main driveshaft of the tufting machine in an operative, driven relationship for reciprocating the cut pile hooks towards and away from engagement with the needles 17A/17B, as indicated by arrows 54/54', as will be understood by those skilled in the art. The hook bars 51 further can be connected to a pivoting shaft 54, to which the knives 45 associated with each cut pile hook 40/41 likewise are connected or mounted, for driving the reciprocating motion of the knives into engagement with their cut pile hook 40/41 for cutting loops of yarns captured thereon to form cut pile tufts 29A/29B in the backing material.

The first and second cut pile hooks 40/41 accordingly will be driven in a timed relationship with the reciprocation of their associated or corresponding needles 17B/17A, moving so that the engagement with the first or second pickup areas of their associated needles. As shown in FIGS. 4A-5A and 5C and 5D, the first or lower cut pile hooks will extend across the tufting zone and engage the pickup areas of the first or upstream rows of needles, while the second or downstream row of needles will be engaged by the second or upper cut pile hooks so as to form a series of loops of different lengths or pile heights. The loops captured along the throats of the first and second cut pile hooks will thereafter be severed by the knives associated therewith to form the tufts of grass yarns in the backing material. As a result, different pile height tufts of yarns can be formed, including first or base tufts 29A and second or varied height tufts 29B as indicated at in FIG. 2.

Figure 5A:
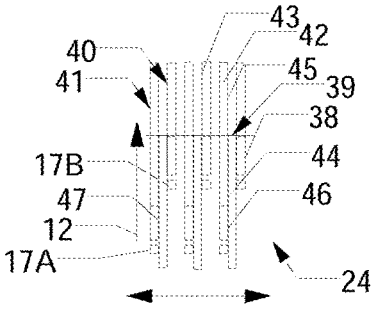
FIGS. 5A-5B are schematic illustrations of the operation of a tufting machine according to one example embodiment of the present invention.
Figure 5B:
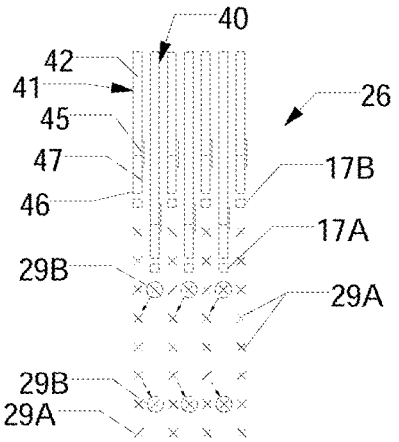
Figure 4B:
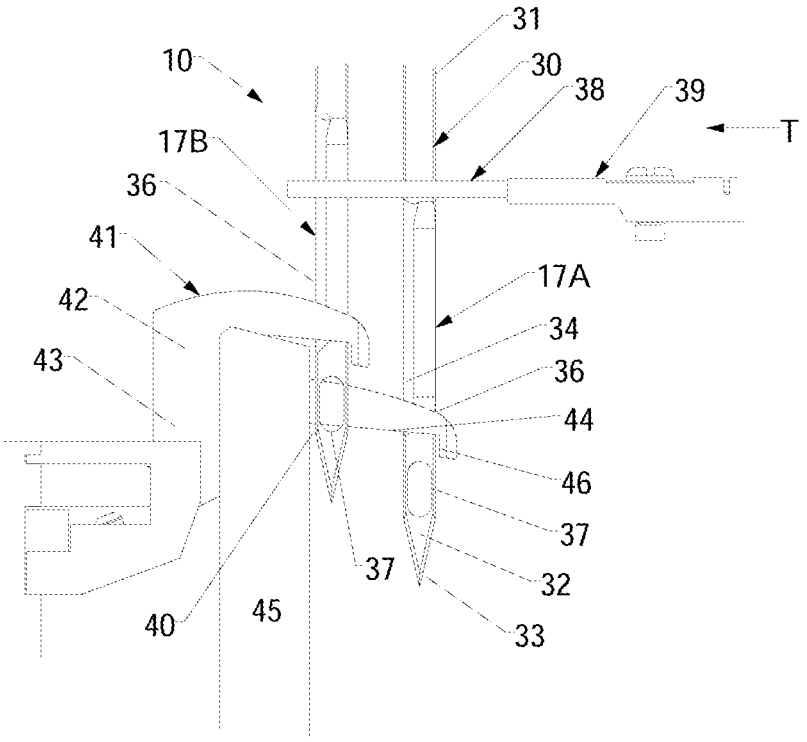
Figure 5C:
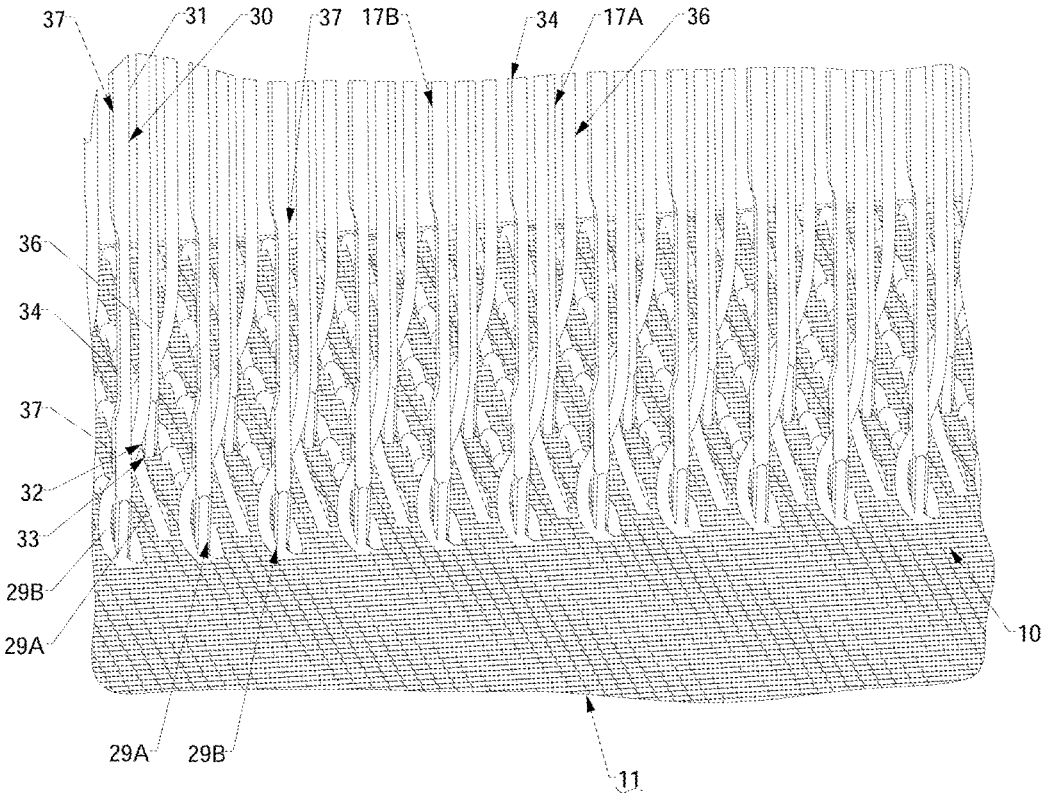
FIGS. 5C-5D are perspective views illustrating the operation of a tufting machine according to one example embodiment of the present invention.
Figure 5D:
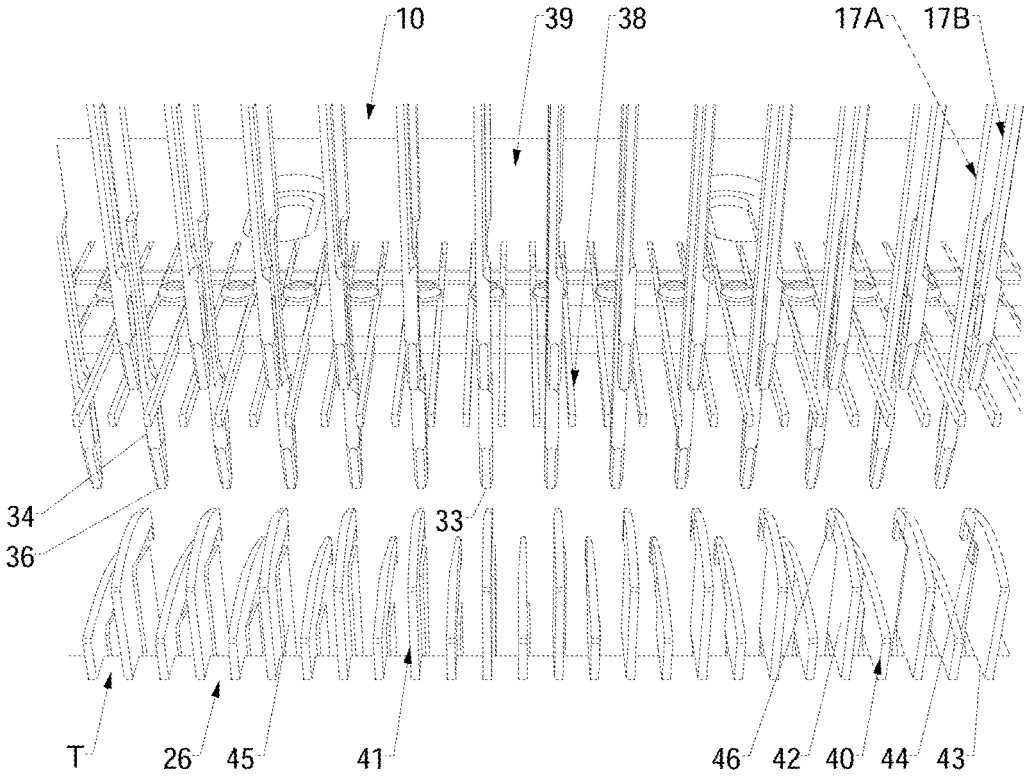

As further indicated in FIG. 5B, the system control can selectively control the shifting of the upstream or first needle bar 16A so as to cause the needles 17A carried therealong to be shifted or stepped into an off-gauge or otherwise misaligned position, for example, being moved approximately half a gauge distance or other selected distance sufficient to move the upstream or first row of needles 17A out of alignment with their corresponding first or lower cut pile hooks 41. As a result, as the needles 17A penetrate the backing material, they generally will not be engaged by their respective or corresponding cut pile hooks 41, which will thus not pick up or pull loops of yarns therefrom. In addition, the upstream yarn feed 21A further can be controlled to back-rob or pull any yarns carried by these needles 17A low to an extent to hold the tufts in the backing while avoiding interference with or showing between the higher tufts or those tufts desired or selected to be seen in the patterned tufted product or turf; or can be removed or pulled back out of the backing material. These yarns can be permitted to float along the backing material, as indicated at 60 in FIG. 2, and with the yarns potentially being tacked or otherwise secured at desired locations. As a further alternative, the pile height of the base cut pile tufts also can be controlled to provide them with a sufficient pile height as needed to provide additional support or stability for the higher cut pile tufts, while being substantially hidden from view among the second series of tufts being formed in selected areas along the face of the resultant tufted artificial grass or turf product being formed.

For example, the system control further can control the yarns being fed to the needles of the first or upstream row of needles, for example, by substantially stopping, limiting or otherwise controlling the feeding of yarns thereto when the first or upstream row of needles have been shifted to their off-gauge or misaligned positions. As a result, these yarns can be controlled so as to be substantially pulled low or out of the backing material and can float across the rear surface of the backing material, as well as to vary pile height of resultant tufts formed thereby. The system control also can selectively shift at least the first or upstream row of needles between off-gauge and on-gauge positions or into positions to be engaged by associated or corresponding ones of the first series of cut pile hooks in order to form the second series of tufts having a different pile height or length in a selected manner. For example, the second series of tufts can be formed in a ratio of approximately 1:1.5 to approximately 1:4 with respect to first or base tufts, although other greater or lesser variations or selective formations of the second tufts in relation to the first series of tufts also can be provided. The first series of tufts thus can form a base fabric or turf generally having a substantially similar or generally consistent pile height or level surface, with the second series of tufts, which can have different pile heights, being intermixed or interspersed therebetween in order to provide the resultant artificial or synthetic turf product with an appearance and/or feel designed to more closely mimic the look and feel of natural grass. In addition, the placement of the second series of tufts further can be used to provide different patterning effects, such as to potentially enable shading or colored patterning effects, and to provide increased density to the resultant artificial or synthetic turf products.

Figure 6A:
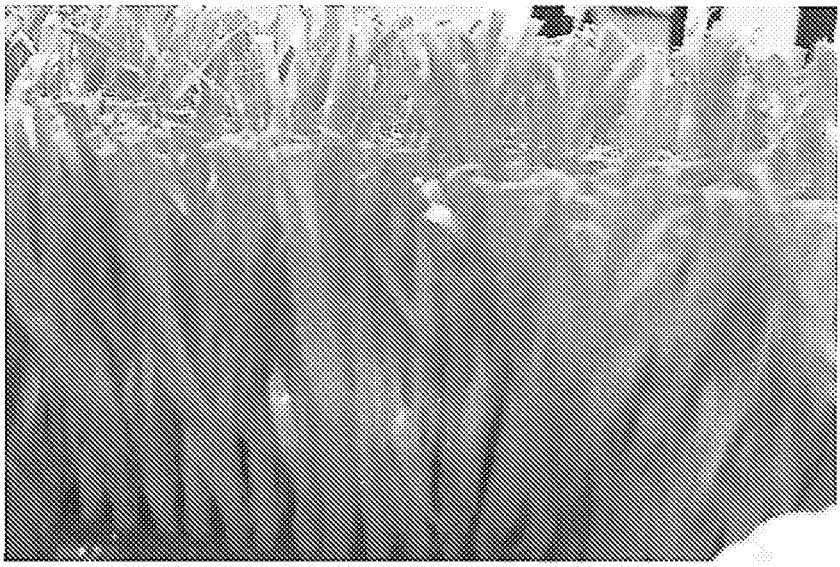
FIGS. 6A-6B are illustrations of tufted turf materials formed according to the principles of the present invention.
Figure 6B:
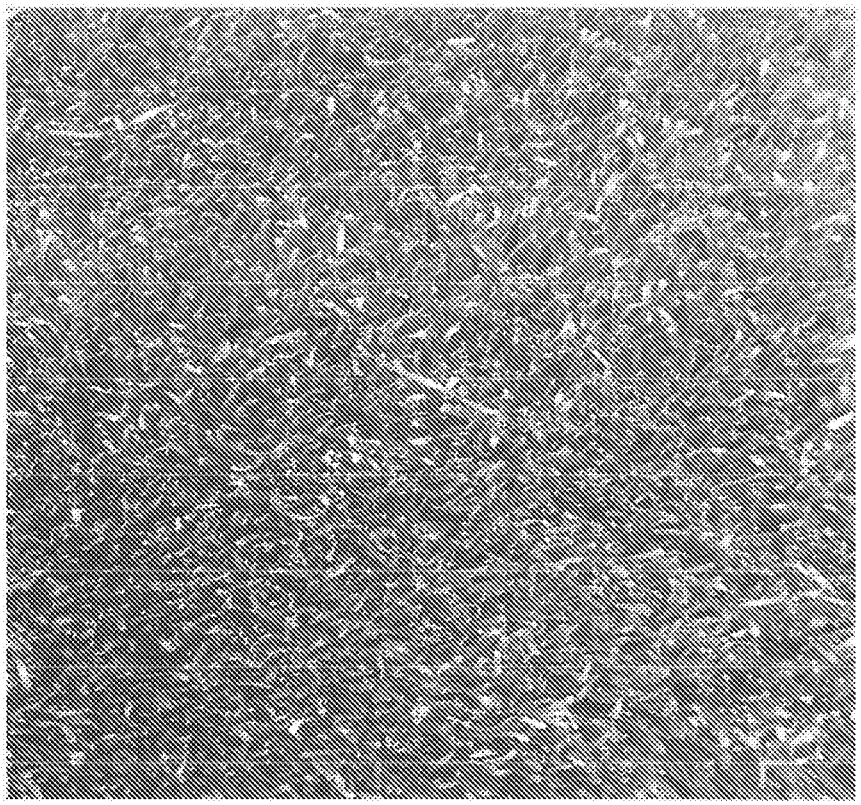

The varied length tufts of yarns accordingly can be selectively formed in the backing material at desired or selected locations within the field of base or first tufts 29A as needed or desired. The resultant tufted turf fabric can thus be provided with a more natural grass appearance, including tufts of varying, different pile heights intermixed or interspersed with tufts of a lower, base pile height, which more closely approximates the appearance of natural grass, as grass generally does not tend to stay at a consistent, unchanging height, such as generally illustrated in FIGS. 6A-6B. The upstream yarn feed mechanism 21A (FIGS. 1-2) further can be controlled to vary the pile height of the second or varying height tufts 29B as needed to enable additional pattern effects, such as provide for desired shading effects and/or for the incorporation of colored filaments or yarns as needed to form graphic designs, but without the need to further remove or substantially pull low the base tufts to provide the desired graphic appearance. As a further result, a tufted turf product having a desired density, including an increased number of tufts per inch, can be formed to provide additional cushioning effects or support to further provide the resultant turf fabric with the more naturalized appearance and feel.

Figure 7:
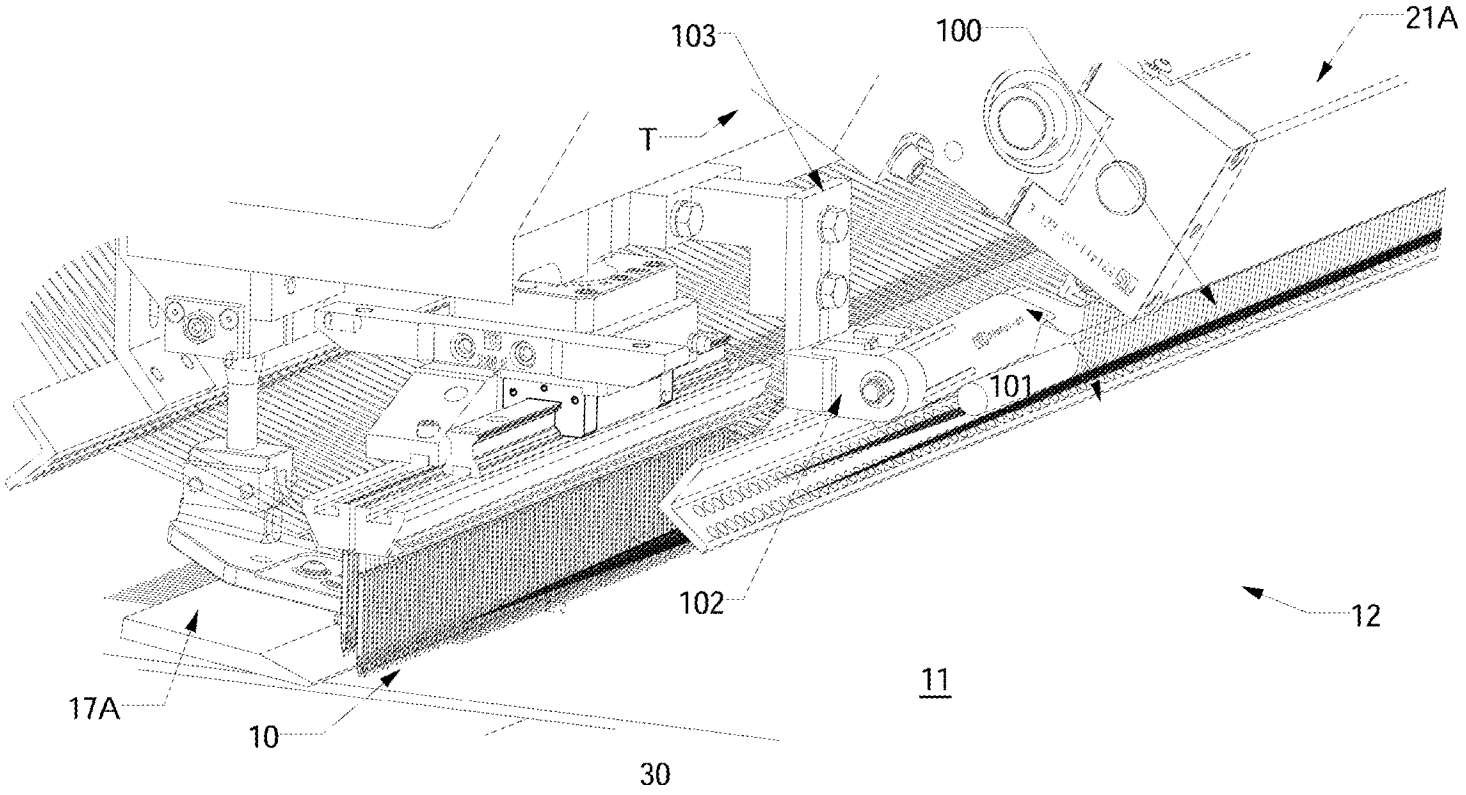
FIG. 7 illustrates the tufting zone of the tufting machine including a yarn jerker and needle guide.

Additionally, as illustrated in FIG. 7, a yarn jerker 100 can be provided between the upstream yarn feed mechanism or device 21A and the yarn guide 23. The yarn jerker 100 generally can comprise an elongated rod or jerker bar 101 extending across the tufting zone 10, with a series of support brackets or holders 102 which movably support the jerker bar 101. The brackets 102 can be pivotally mounted on supports 103 and can be biased forwardly, so as to maintain the jerker bar in a forward position to help maintain a desired tension on the yarns Y-1, etc. . . . being fed to the needles 17A when the front yarn feed is slowed or stopped and the second series of tufts are not to be formed or shown. A biasing mechanism, such as spring, pneumatic cylinder, solenoid, or other, similar mechanism can engage and urge the brackets, and/or the jerker bar itself, toward its forward, extended position to help maintain yarn tension in the yarns Y-1 as the needles are reciprocated into and out of the backing material 11, even while the yarn feed is reduced or substantially stopped.

The artificial/synthetic sports grass or turf fabric formed according to the present invention additionally can be formed with multiple cut pile and/or other types of tufts, while generally being run in a single pass through the tufting machine, rather than requiring multiple tufting passes and overtufting of the tufted fabric. Additionally, two different length needles can be used, if needed, although it is also possible to use needles of substantially the same length mounted on separate needle bars, and/or with the needles being staggered in terms of their elevation or depth to enable different penetration levels. Still further, the needles can be mounted on a single needle bar in a staggered needle configuration or spacing, or with the needles arranged in-line along the needle bar, and the stroke of the needle bar can be based upon a stroke length or penetration depth required for the longest needle to penetrate and be engaged by corresponding cut pile hooks, loop pile loopers or LCL loopers.

Still further, it also will be understood that in addition to various pattern mechanisms or systems, such as mechanisms or devices to control the feeding of the yarns to the needles and/or movement of the needle bar(s) to prevent excess yarn from being pulled and left on top of the backing material, other patterning systems/attachments for forming various pattern effects, such as sculptured or textured pile effects, or the formation of logos or other designs using various different colors and shades of yarn, including backing feed shifters and other pattern systems, also can be used. For example, the present system can utilize a backing control system such as Card-Monroe Corp.'s Virtual Weave™ to control the shifting of the backing material. Such a backing feed control further can be used in conjunction with one or more shifting needle bars (although shifting needle bar(s) are not required), as well as various pattern yarn feed mechanisms to provide further enhanced patterning and formation of desired visual effects.

Still further, positive stitch placement also can be utilized in operation of the tufting machine, whereby the needle bar(s) are incrementally shifted laterally, generally by an amount or distance less than a spacing or gauge between the needles, back and forth across the backing material as they are reciprocated to form tufts in the backing material. Such positive stitch placement movement of the needles can be done apart from and/or in addition to the needles being shifted in steps or jumps, such as based on the gauge spacings or multiples thereof of the needles mounted along the needle bar, as needed or desired for pattern formation, in order to tighten and substantially eliminate rowing effects of the tufts formed along longitudinal tuft rows in the backing material and to help create a stronger, more natural looking and denser tufted feel to the tufted article. In addition, loop pile tufts can be formed with sufficient density, height, and spacing, to provide enhanced support for the cut pile tufts that generally are of higher pile heights. This can help reduce the amount of fill needed for supporting the tufts, as well as providing better control of the yarn feed to allow for lower weights to the yarns to be used and reduced pile heights of the tufts in order to get the desired density required for enhanced player comfort, support, and ball bounce.

As a result, the finished tufted article, such as a carpet, rug or turf fabric can be formed with a variety of graphic designs and other pattern effects with enhanced clarity and sharpness, and with the tufts of the resultant tufted fabric potentially having enhanced rigidity, resistance, strength and being more resistant to bending over due to loads such as crushing forces during use/play thereon. Still further, the use of various pattern devices as discussed above can enable variable pile heights for the cut and loop pile tufts so as to vary the characteristics of tufted turf fabrics as needed to meet various desired standards for cushioning, support, ball roll, and ball bounce, all while helping to reduce the amount of fill with particulate matter required for support of the tufts, and further enable various designs or pattern effect to also be formed in the resultant tufted turf fabrics.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A method of forming patterned tufted articles, comprising:

moving a backing through a tufting zone;

reciprocating a first and a second series of needles into the backing so as to present a series of yarns carried thereby at different penetration depths;

as the needles penetrate the backing and present the series of yarns carried thereby to each stitch area, engaging the first series of needles with a first series of gauge parts and engaging the second series of needles with a second series of gauge parts so as to form tufts of yarn in the backing of different pile heights;

shifting the first series of needles to an off-gauge position; and controlling feeding of the yarns to the needles of the first series of needles to selectively pull back at least a portion of the yarns carried thereby.

2. The method of claim 1, wherein reciprocating the first and second series of needles into the backing comprises moving the first and second series of needles through the backing to a depth sufficient to enable engagement of the first series of needles by first gauge parts at a first elevation, and the second series of needles by a second series of cut pile hooks at a second elevation.

3. The method of claim 1, further comprising forming a first series of tufts of a first pile height by engagement of the second series of needles with the second gauge parts, and forming a second series of tufts having a second pile height that is greater than the first pile height at selected locations in the backing by engagement of the first series of needles with the first gauge parts.

4. The method of claim 1, further comprising shifting the first series of needles by a distance less than a gauge spacing between the needles of the first series of needles and sufficient to move tufts of yarns being formed in longitudinal tuft rows of the pattern at least partially out of alignment.

5. The method of claim 1, wherein controlling feeding of the yarns comprises feeding the yarns to the first series of needles from a pattern yarn feed attachment, and feeding the yarns to the second series of needles from a series of standard yarn feed rolls.

6. The method of claim 1, wherein controlling feeding of the yarns comprises backrobbing the yarns fed to the first series of needles sufficient to remove at least some of the selected yarns from the backing.

7. The method of claim 1, wherein controlling the feeding of the yarns further comprises substantially stopping feeding of yarns to the first series of needles when the first series of needles are shifted to the off-gauge position.

8. A tufting machine, comprising:

backing feed rolls for feeding a backing material through a tufting zone;

a pair of needle bars carrying a first and second series of needles in a reciprocating movement into and out of the backing material, each needle carrying a yarn and having a pick-up area; and wherein the pick-up areas of the needles of the first series of needles are at a different elevation from the pick-up areas of the second series of needles;

first and second yarn feed mechanisms for feeding the yarns to the needles of the first and second series of needles;

a series of cut pile hooks reciprocated into engagement with the first series of needles along the first pickup areas thereof for forming tufts of yarns of a selected pile height in the backing material;

a series of additional gauge parts adapted to be movable into engagement with the pickup areas of the second series of needles to form tufts of yarns in the backing material at a different pile height than the tufts of yarns formed by the series of cut pile hooks; and at least one shift mechanism for shifting the first series of needles transversely with respect to the backing material so as to retard pickup of non-selected yarns therefrom;

wherein the yarns fed to the series of cut pile hooks are controlled when the first series of needles are shifted to an off-gauge position so as to pull the non-selected yarns low or out of the backing material.

9. The tufting machine of claim 8, further comprising a yarn jerker between the yarn feed mechanism and the needles, the yarn jerker comprising a jerker bar engaging the yarns and a biasing mechanism urging the jerker bar toward a position to apply tension to the yarns.

10. The tufting machine of claim 8, wherein the first yarn feed mechanism comprises a pattern yarn feed mechanism, and the second yarn feed mechanism comprises standard yarn feed rolls.

11. The tufting machine of claim 8, wherein the additional gauge parts comprise a second series of cut pile hooks.

12. A method of forming patterned artificial turf products, comprising:

moving a backing through a tufting machine;

reciprocating a first series of needles into the backing, the first series of needles carrying a first series of yarns into the backing to a first [penetration depth;

reciprocating a second series of needles into the backing, the second series of needles carrying a second series of yarns to a second penetration depth that is different from the first penetration depth;

as the needles penetrate the backing, and engaging the second series of needles with a second series of gauge parts so as to form first tufts of a first of base pile height, and engaging the first series of needles with a first series of gauge parts to form a second series of tufts of a second, different pile height;

shifting the first series of needles to an off-gauge position; and controlling feeding of the yarns to the needles of the first series of needles to selectively pull back at least a portion of the yarns carried thereby.

13. The method of claim 12, wherein reciprocating the first and reciprocating the second series of needles into the backing comprises moving the first and second series of needles through the backing to a depth sufficient to enable engagement of the first series of needles by first gauge parts at a first elevation, and the second series of needles by a second series of cut pile hooks at a second elevation.

14. The method of claim 12, further comprising shifting the first series of needles by a distance less than a gauge spacing between the needles of the first series of needles and sufficient to move tufts of yarns being formed in longitudinal tuft rows of the pattern at least partially out of alignment.

15. The method of claim 12, wherein controlling feeding of the yarns comprises feeding the yarns to the first series of needles from a pattern yarn feed attachment, and feeding the yarns to the second series of needles from a series of standard yarn feed rolls.

16. The method of claim 12, wherein controlling feeding of the yarns comprises backrobbing the yarns fed to the first series of needles sufficient to remove at least some of the selected yarns from the backing.

17. The method of claim 16, wherein controlling the feeding of the yarns further comprises substantially stopping feeding of yarns to the first series of needles when the first series of needles are shifted to the off-gauge position.

* * * * *